US009009930B2

(12) United States Patent
Plourde

(10) Patent No.: US 9,009,930 B2
(45) Date of Patent: Apr. 21, 2015

(54) STRAP FORMED SLIDER END STOPS

(71) Applicant: Illinois Tool Works Inc., Glenview, IL (US)

(72) Inventor: Eric Plourde, Frankfort, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 13/933,586

(22) Filed: Jul. 2, 2013

(65) Prior Publication Data

US 2014/0059812 A1 Mar. 6, 2014

Related U.S. Application Data

(60) Provisional application No. 61/697,500, filed on Sep. 6, 2012.

(51) Int. Cl.
*A44B 1/04* (2006.01)
*B65D 33/25* (2006.01)

(52) U.S. Cl.
CPC ..... *B65D 33/2591* (2013.01); *Y10T 24/2598* (2015.01)

(58) Field of Classification Search
CPC ..... B65D 33/2591; Y10T 24/2598
USPC ..... 24/30.5 R, 399, 400, 435, 436, 433, 409; 383/64
See application file for complete search history.

(56) References Cited

U.S. PATENT DOCUMENTS

| | | | | |
|---|---|---|---|---|
| 5,067,208 | A * | 11/1991 | Herrington et al. | 24/400 |
| 5,788,378 | A * | 8/1998 | Thomas | 383/63 |
| 5,911,508 | A * | 6/1999 | Dobreski et al. | 383/5 |
| 6,481,183 | B1 * | 11/2002 | Schmidt | 53/412 |
| 6,663,283 | B1 * | 12/2003 | Cappel | 383/5 |
| 2002/0154835 | A1 * | 10/2002 | Galomb | 383/10 |

* cited by examiner

*Primary Examiner* — Robert J Sandy
*Assistant Examiner* — Matthew Sullivan
(74) *Attorney, Agent, or Firm* — McCarter & English, LLP

(57) ABSTRACT

The present disclosure relates to end stops for slider zippers for reclosable packages or bags wherein the end stops are formed by straps which are inserted and secured within apertures in the zipper, proximate to the ends of the zipper. The ends of the straps are joined to each other to form loops. This joining may be done with a fin seal, a lap seal, a separate rivet, an integral rivet or similar structure.

10 Claims, 3 Drawing Sheets

STRAP FORMED SLIDER END STOPS

This application claims priority under 35 U.S.C. §119(e) of provisional application Ser. No. 61/697,500 filed on Sep. 6, 2012.

BACKGROUND OF THE DISCLOSURE

1. Field of the Disclosure

The present disclosure relates to end stops for a reclosable slider zipper. The end stops are formed by a strap configuration.

2. Description of the Prior Art

In the prior art, it is well-established that a slider zipper for a reclosable package or bag requires end stops at the ends of the zipper to prevent the slider from being withdrawn or pulled from the ends of the zipper. This is typically done by providing an enlargement on the ends of the zipper in order to prevent movement of the slider past these enlargements. While this structure is well-adapted and suitable for its intended purposes, further improvements are sought, particularly with respect to simplifying of manufacturing steps, reducing costs of manufacture, and increasing of manufacturing speed.

OBJECTS AND SUMMARY OF THE DISCLOSURE

It is therefore an object of the present disclosure to simplify the manufacturing of slider zippers, as well as reduce the costs of manufacture and increasing the manufacturing speed thereof, while maintaining the required resistance to removal of the slider from the zipper.

These and other objects are attained by providing end stops in the form of straps which are inserted or secured into openings and looped near the ends of the slider zipper.

BRIEF DESCRIPTION OF THE DRAWINGS

Further objects and advantages of the disclosure will become apparent from the following description and from the accompanying drawings, wherein.

DETAILED DESCRIPTION OF THE PREFERRED EMBODIMENTS

Figure 1:
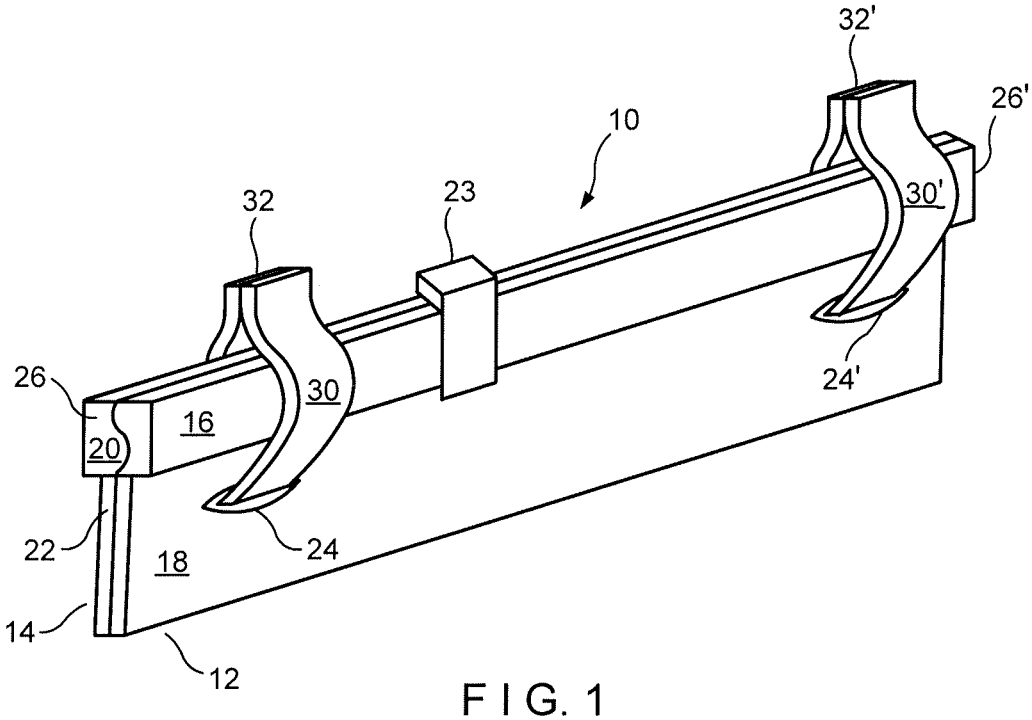
FIG. 1 is a perspective view of a first embodiment of the disclosure.

Referring now to the drawings in detail wherein like numerals indicate like elements throughout the several views, one sees that FIG. 1 is a perspective view of the zipper 10 which is typically made from polymeric material and includes first and second profiles 12, 14 which are co-extensive with each other. Zipper 10 is intended for use in reclosable packages, pouches, bags or similar applications. Those skilled in the art, after review of the present disclosure, would realize that there is a broad range of prior art profile designs which could be incorporated into embodiments of the present disclosure. In the embodiment illustrated in FIG. 1, first profile 12 includes first interlocking element 16 and first flange 18. Second profile 14 includes second interlocking element 20 and second flange 22. As is known, first and second flanges 18, 22 are used for sealing, joining or otherwise connecting to bag walls of a reclosable package (not shown). Slider 23 is mounted on the first and second interlocking elements 16, 20 and operates to separate the interlocking elements if moved in an opening direction and operates to join or close the interlocking elements if moved in a closing direction, opposite to the opening direction. End seals may be formed at the ends 26, 26' of zipper 10 by sealing together the respective ends of first and second profiles 12, 14 to each other. Alternately, the end seals could be omitted and the zipper 10 held together by straps 30, 30' with the respective ends of the first and second profiles 12, 14 aligned and positioned side-by-side as shown in the various figures. Apertures or slits 24, 24' are formed through first and second flanges 18, 22 near, or inwardly adjacent from, the ends 26, 26' of the zipper 10. A substantially identical end stop and aperture or slit with substantially identical associated structure is found at each end 26, 26' of zipper 10. Continuous lengths of polymeric, polyolefin or similar heat-sealable material are passed through apertures 24, 24', looped above the first and second interlocking elements 16, 20 of zipper 10 and cut thereby forming straps 30, 30'. The ends are sealed in fin seals 32, 32'. The fin seals 32, 32' may be made using heat, ultrasonics, adhesive, or any similar method. The apertures or slits 24, 24' may be made with a blade or possibly by a pointed end of the material forming straps 30, 30'. The resulting structure provides end stops to prevent the slider 23 from being pulled from ends 26, 26'.

Figure 2:
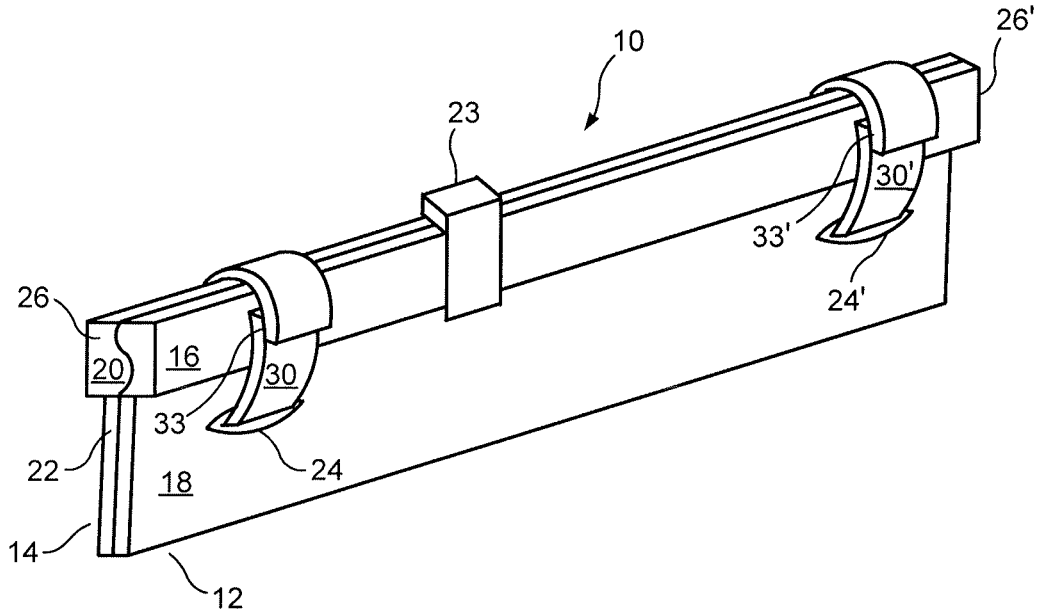
FIG. 2 is a perspective view of a second embodiment of the disclosure.

FIG. 2 illustrates a similar embodiment except that lap seals 33, 33' are substituted for fin seals 32, 32' on the straps 30, 30'.

Figure 3:
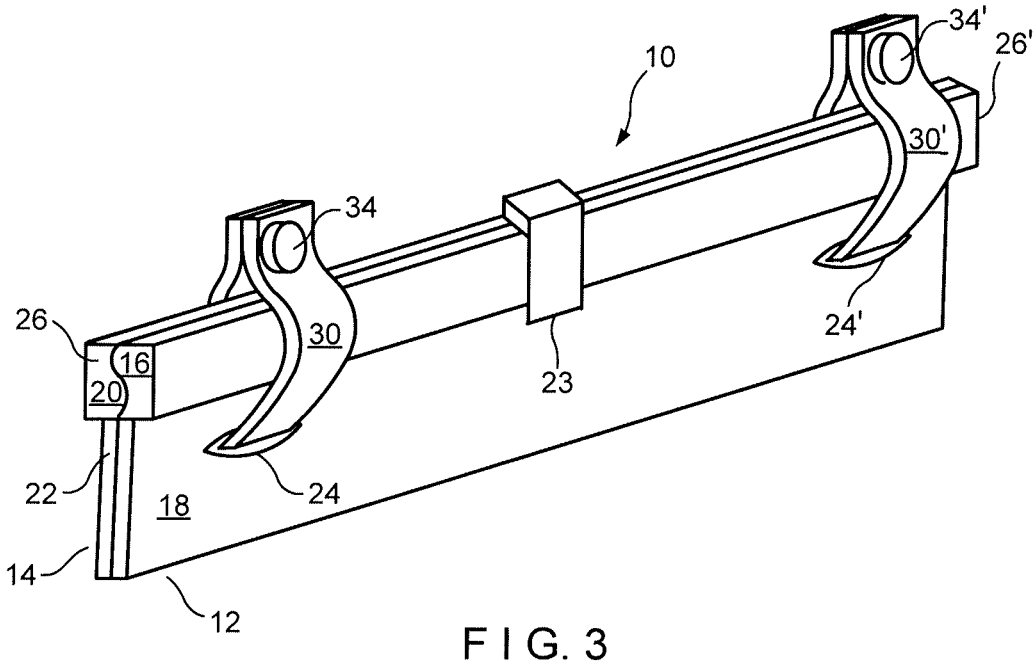
FIG. 3 is a perspective view of a third embodiment of the disclosure.

FIG. 3 illustrates a similar embodiment except that melted rivets 34, 34' are substituted for the fin seals 32, 32' or lap seals 33, 33', with a fin-type end configuration resulting in the straps 30, 30'. Alternately, a lap-type end configuration could be used.

Figure 4:
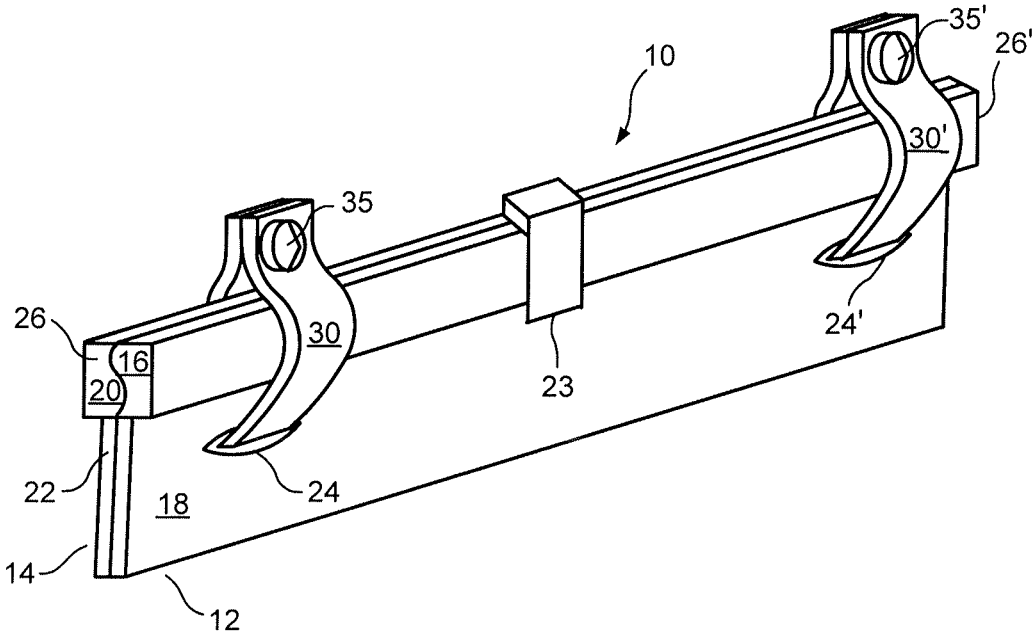
FIG. 4 is a perspective view of a fourth embodiment of the disclosure.

FIG. 4 illustrates a similar embodiment except that snap fit rivets 35, 35' are substituted for the fin seals 32, 32', lap seals 33, 33' or melted rivets 34, 34', with a fin-type end configuration resulting in the straps 30, 30'. In both FIGS. 3 and 4, the rivets 34, 34' or 35, 35' can be a separate piece or integral with the straps 30, 30'. Alternately, a lap-type end configuration could be used.

Additionally, the apertures 24 can be eliminated by fusing portions of the straps 30, 30' to the respective first and second flanges 18, 22. That is, for any of FIGS. 1-4, the straps 30, 30' would each be replaced by first strap segment extending from a respective end of the first flange 18 and a second strap segment extending from a respective end the second flange 22. The respective first and second strap segments would then be joined to each other in manners shown in FIGS. 1-4. These alternative configurations would typically require end seals between the first and second profiles 12, 14 at ends 26, 26' of the zipper.

Figure 5:
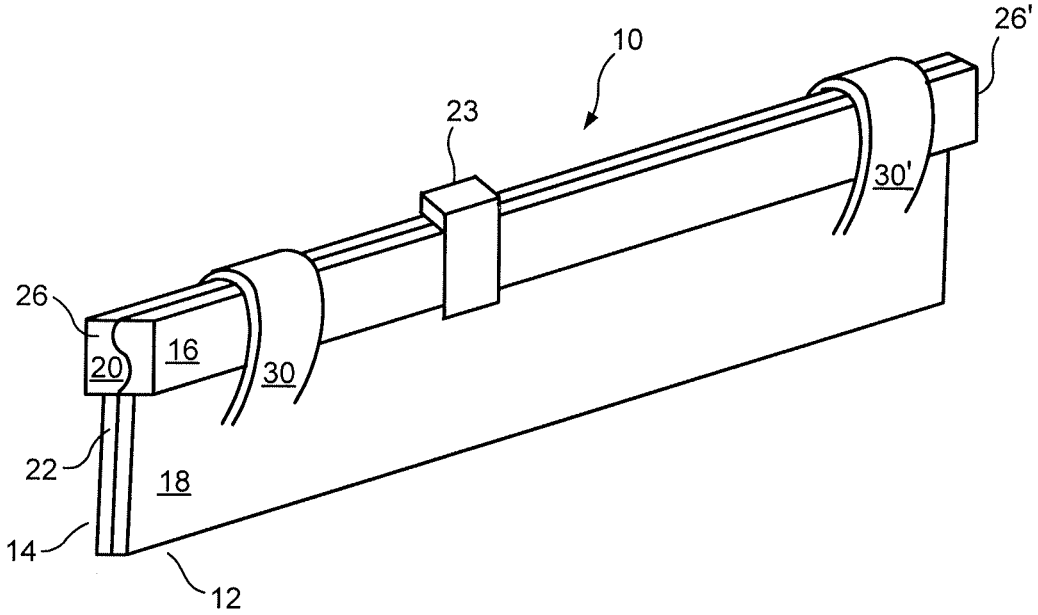
FIG. 5 is a perspective view of a fifth embodiment of the disclosure.

Further, as shown in FIG. 5, straps 30, 30' could be integral with both the first and second flanges 18, 22, looping over the interlocking element 16, 20, thereby eliminating the need for further attachment of the straps. This alternative configuration would typically require end seals between the first and second profiles 12, 14 at ends 26, 26' of the zipper.

Thus the several aforementioned objects and advantages are most effectively attained. Although preferred embodiments of the invention have been disclosed and described in detail herein, it should be understood that this invention is in no sense limited thereby and its scope is to be determined by that of the appended claims.

What is claimed is:

1. A zipper for a reclosable package, comprising:

a first interlocking profile;

a second interlocking profile;

the first and second interlocking profiles each including a first end and a second end, and wherein the first and second interlocking profiles are co-extensive with each other;

a slider operating to separate the first and second interlocking profiles when moved in an opening direction and operating to interlock the first and second interlocking profiles when moved in a closing direction;

the first and second interlocking profiles each including a first opening inwardly adjacent from the first end and a second opening inwardly adjacent from the second end;

a relatively central continuous portion of a first strap passing through the first openings of the first and second interlocking profiles and a relatively central continuous portion of a second strap passing through the second openings of the first and second interlocking profiles;

the first strap and the second strap each including a first strap end and a second strap end;

the first strap end and the second strap end of the first strap being joined to each other away from the first openings of the first and second interlocking profiles thereby forming a first loop and preventing the slider from being pulled from the first end of the zipper; and the first strap end and the second strap end of the second strap being joined to each other away from the second openings of the first and second interlocking profiles thereby forming a second loop and preventing the slider from being pulled from the second end of the zipper.

2. The zipper of claim 1 wherein the first profile includes a first interlocking element and a first flange and wherein the second profile includes a second interlocking element and a second flange.

3. The zipper of claim 2 wherein the first and second openings of the first profile are formed in the first flange and wherein the first and second openings of the second profile are formed in the second flange.

4. The zipper of claim 3 wherein the first and second openings are selected from the group consisting of an aperture and a slit.

5. The zipper of claim 3 wherein the first and second loops each extend over the first and second interlocking elements.

6. The zipper of claim 3 wherein the first and second strap ends of the first strap are joined by a fin seal and the first and second strap ends of the second strap are joined by a fin seal.

7. The zipper of claim 3 wherein the first and second strap ends of the first strap are joined by a lap seal and the first and second strap ends of the second strap are joined by a lap seal.

8. The zipper of claim 3 wherein the first and second strap ends of the first strap are joined by a first rivet and the first and second strap ends of the second strap are joined by a second rivet.

9. The zipper of claim 3 wherein the first and second strap ends of the first strap are joined by a first rivet integral with the first strap and the first and second strap ends of the second strap are joined by a second rivet integral with the second strap.

10. The zipper of claim 1 wherein the zipper is made from polymeric material.

* * * * *